United States Patent [19]

Arima

[11] Patent Number: 4,973,943

[45] Date of Patent: Nov. 27, 1990

[54] SIGNAL CONTROL SYSTEM USING TWO SYNCHRONOUS RING COUNTER CIRCUITS

[76] Inventor: Takeo Arima, 4-30-29, Kitakarasuyama, Setagaya-ku, Tokyo, Japan

[21] Appl. No.: 371,739

[22] Filed: Jun. 26, 1989

[30] Foreign Application Priority Data

Mar. 23, 1989 [JP] Japan ..... 1-71065

[51] Int. Cl.[5] ..... G08B 29/00

[52] U.S. Cl. ..... 340/506; 340/505; 340/508; 340/512; 340/518; 340/533

[58] Field of Search ..... 340/506, 505, 508, 512, 340/518, 533, 825.05, 825.14; 370/85.12, 85.15

[56] References Cited

U.S. PATENT DOCUMENTS 3,824,545 7/1974 Brenner et al. ..... 370/85.15
3,904,829 9/1975 Martin et al. ..... 370/85.12
4,241,330 12/1980 Hery et al. ..... 340/825.05
4,290,055 9/1981 Furney et al. ..... 340/505
4,542,496 9/1985 Takeyama et al. ..... 370/85.12

*Primary Examiner*—Donnie L. Crosland
*Attorney, Agent, or Firm*—Bauer & Schaffer

[57] ABSTRACT

A signal control system for transmission circuits which includes two ring counter type transmission circuits respectively formed of a plurality of transmitter-receivers located opposite to each other, a control circuit, and a couple of signal lines respectively formed of two alternate signal lines, a control signal line and a transmission line. The first pair formed of the first transmitter-receivers of the respective two transmission circuits are simultaneously operated, and subsequent pairs of the transmitter-receivers of the transmission circuits are synchronously operated in turn by a shift pulse. The system can transmit signals and control the transmission circuits without complicated circuits such as an address circuit and a verification circuit so that the construction is simplified and its power consumption is largely reduced.

10 Claims, 5 Drawing Sheets

SIGNAL CONTROL SYSTEM USING TWO SYNCHRONOUS RING COUNTER CIRCUITS

BACKGROUND OF THE INVENTION

This invention relates generally to a signal control system, and more particularly to a system of this kind which is adapted to transmit to and receive from a remote location collective or distributed signals by the use of ring counter circuits.

Many of central administrative systems for monitoring and controlling a variety of signals employ a so-called two-line multiplex transmission system which permits transmission and reception of many signals with less conductive lines for the purpose of reducing wiring material. There have been proposed and practically used many systems employing a variety of circuit means in accordance with the purpose, use and conditions.

Such multiplex transmission system connects a pair of signal lines with multiple signal means which are respectively designated an address number. When signals are monitored or transmitted, an addressing function of all the transmitting means are always maintained in operating condition to confirm the address numbers. Also, the signal transmission is carefully checked, for example, by verification and double transmission, so as to avoid malfunctions caused by signal disturbance due to noise or the like. Thus, a great amount of pulses and transmission time are spent, for transmission and reception of only one signal, so as to improve the fidelity of signal.

Each signal means is supplied with an electric power from a pair of common lines for the indispensable addressing function. Therefore, even if integral circuits are employed to reduce the power consumption, a line current is increased in a monitoring condition as the number of connected signal means is larger.

In the above-mentioned multiplex transmission system, all the signal means are always operated simultaneously, and a current supplied to them is delivered through a pair of common lines, so that the current value becomes large in the whole system. A large line current implies a problem on a voltage drop, if supplied to signal means at remote locations, whereby several difficulties are encountered, for example, limitation of the number of connectable signal means, limitation in extendible distance of signal lines, requirement of large diameter wire, and so on.

Further, a double or even triple transmission of signal and verification are effected in order to ensure signal transmission and reception, whereby an amount of pulses used for each signal means is largely increased, with the result that the response time is delayed due to the redundancy of the transmission time. However, a high speed processing of pulses, for reducing the transmission time, can cause signal distortion and deteriorate noise durability. Also, in such case, a shield wire is employed for signal lines to ensure the stability. As a result, the production cost of the whole system is inevitably increased.

The unit of signal employed by the signal means is 2, 4, 8 and 16 units of the logical circuit. Also, in a facility where signals are distributed, wiring is arranged in a radial form directly from the signal means to a signal source. Therefore, several disadvantages will be present when a facility is to be enlarged or modified, for example, a portion of wiring becomes useless. Thus, the above-mentioned system is somewhat awkward to handle as a common line system.

Furthermore, integration of the signal means comprises following difficulties: First, the signal means uses many parts so that it is difficult to reduce its size. Employment of shield wire and the complicated arrangement makes the prime cost higher. Finally, since high technologies are applied to manufacturing, settlement and maintenance, larger expenses are required in every procedure.

OBJECTS AND SUMMARY OF THE INVENTION

In view of the problems mentioned above, it is an object of the present invention to eliminate the above-mentioned problems.

It is another object of the present invention to provide a simple signal control system which does not need complicated circuits, such as an address circuit and a verification circuit required by conventional systems, and largely reduce the power consumption.

It is a further object of the present invention to provide an signal control system which provides a high noise durability, a stable operation and a protection against troubles such as short-circuit.

According to the present invention, there is provided a signal control system for transmission circuits comprising:

- two ring counter type transmission circuits respectively formed of a plurality of transmitter-receivers located opposite to each other;
- control means; and
- a couple of signal lines respectively formed of two alternate signal lines, a control signal line and a transmission line, wherein the first pair formed of the first transmitter-receivers of the respective two transmission circuits are simultaneouslY operated, and subsequent pairs of the transmitter-receivers of the transmission circuits are synchronously operated in turn by a shift pulse.

The above and other objects, features and advantages of the invention will be more apparent from the ensuing detailed description taken in conjunction with the accompanying drawings.

DETAILED DESCRIPTION OF THE PREFERRED EMBODIMENT

Figure 1:
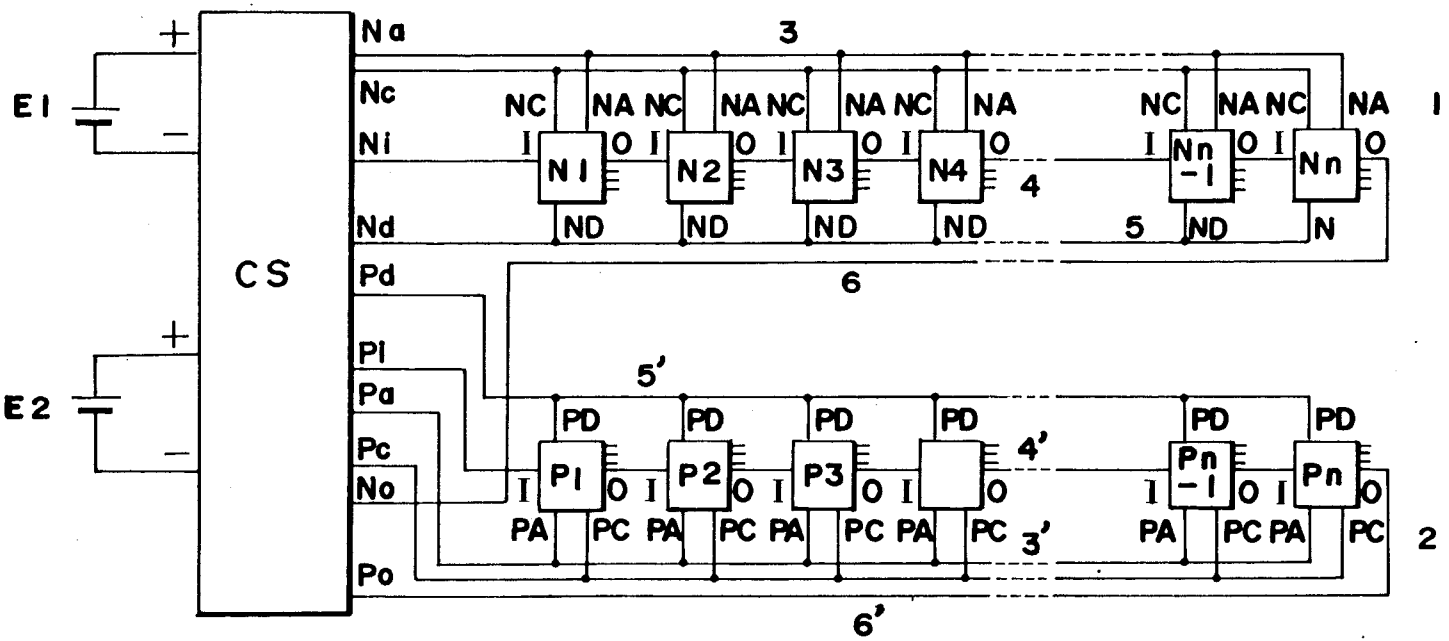
FIG. 1 is a circuit block diagram showing an arrangement of one embodiment of a signal control system according to the present invention.

FIG. 1 shows an embodiment of a synchronous ring counter type bi-directional signal control system according to the present invention, comprising two transmission circuits, i.e. an N transmission circuit 1 and a P transmission circuit 2, and a direct current source E1. The system also includes a control circuit CS and another power source E2 for operating circuits. It is assumed in the present embodiment that the N transmission circuit 1 is used as a signal control circuit for remote locations.

The direct current source E1 is connected through a polarity alternating circuit X to a current regulating circuit CR1 in series to generate an alternate signal at output terminals A and C.

The control circuit CS is connected to respective alternate current conductive line terminals NA of N transmitter-receivers with its terminal Na and to respective alternate current conductive line terminals NC of the N transmitter-receivers with its terminal Nc. All the N transmitter-receivers N1-Nn are connected to the N transmission circuit 1 in parallel.

Also, the control circuit CS is connected to respective alternate current conductive line terminals PA of P transmitter-receivers with its terminal Pa and to respective alternate current conductive line terminals PC of the P transmitter-receivers with its terminal Pc. All the P transmitter-receivers P1-Pn are connected to the P transmission circuit 2 in parallel.

Since the control circuit CS has its terminals Nc and Pa connected to the N transmission circuit 1 and the P transmission circuit 2, respectively, so that the N and P transmission circuits 1 and 2 are connected in serial to each other.

In the above circuit arrangement, an alternate signal output terminal A is connected to the terminal Na and an alternate signal output terminal C to the terminal Pa.

A driving terminal Ni of the control circuit CS is connected to a transmission line terminal I of the first stage transmitter-receiver N1 of the N transmission circuit 1. In the same manner, a driving terminal Pi of the control circuit CS is connected to a transmission line terminal I of the first stage transmitter-receiver P1 of the P transmission circuit 2.

Each of the transmitter-receivers of the respective transmission circuits has its transmission line terminal 0 connected to the transmission line terminal I of the transmitter-receiver at the next stage through a transmission line 4 or 4'. In the similar manner, all the transmitter-receivers are serially connected to each other in the transmission order through the transmission line 4 or 4'.

Further, a terminal Nd of the control circuit CS for coupling a signal control is connected to respective signal control circuit terminals ND of all the N transmitter-receivers in parallel through a signal control line 5. Similarly, a terminal Pd for coupling a control signal is connected to respective signal control circuit terminals PD of all the P transmitter-receivers in parallel through a control signal line 5'. Therefore, the transmission circuits 1 and 2 are respectively arranged with a total of four lines.

The transmitter-receivers of the respective transmission circuits effects a stepping operation in the above described arrangement.

Figure 2A:
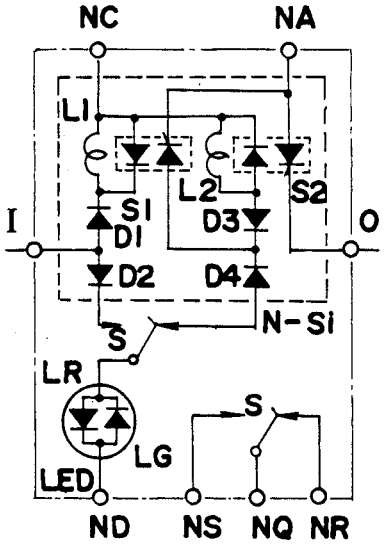
FIGS. 2A to 2F are circuit diagrams respectively showing a transmitter-receiver employed in the present invention.
Figure 2B:
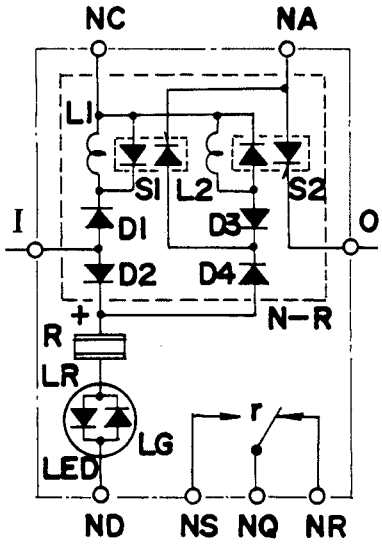
Figure 2C:
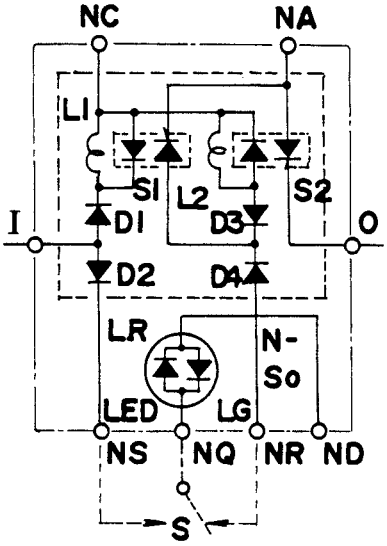
Figure 2D:
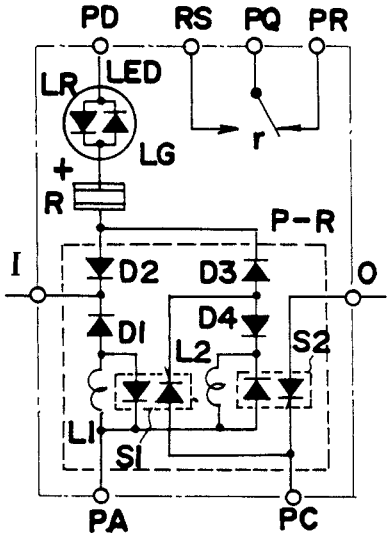
Figure 2E:
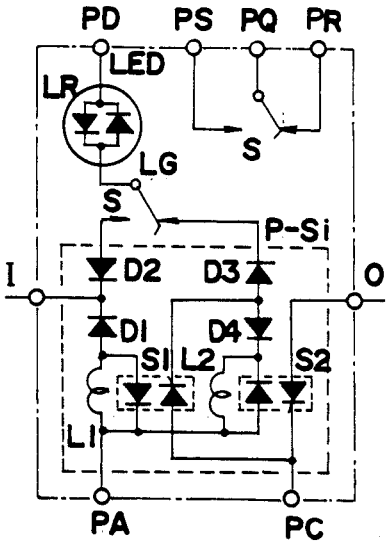
Figure 2F:
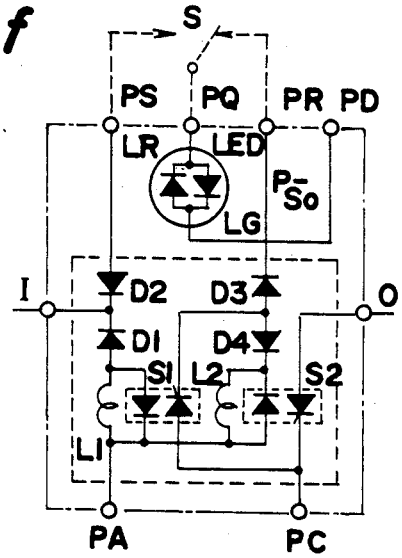

FIGS. 2A-2F show several kinds of transmitter-receivers and receivers. A transmitter-receiver N-Si of the N transmission circuit 1 of FIG. 2A is combined with a receiver P-R of the P transmission circuit 2 of FIG. 2D to form a pair. Also, a transmitter-receiver P-Si of the P transmission circuit of FIG. 2E is combined with a receiver N-R of the N transmission circuit 1 of FIG. FIG. 2B to form a pair. Such pair of combined transmitter-receiver and receiver allows the two transmission circuits 1 and 2 to carry out a bi-directional transmission control therebetween. The system is formed of four kinds of circuits. Further, transmitter-receivers N-So and P-So four kinds of connecting to the outside are shown in FIGS. 2C and 2F.

Figure 3:
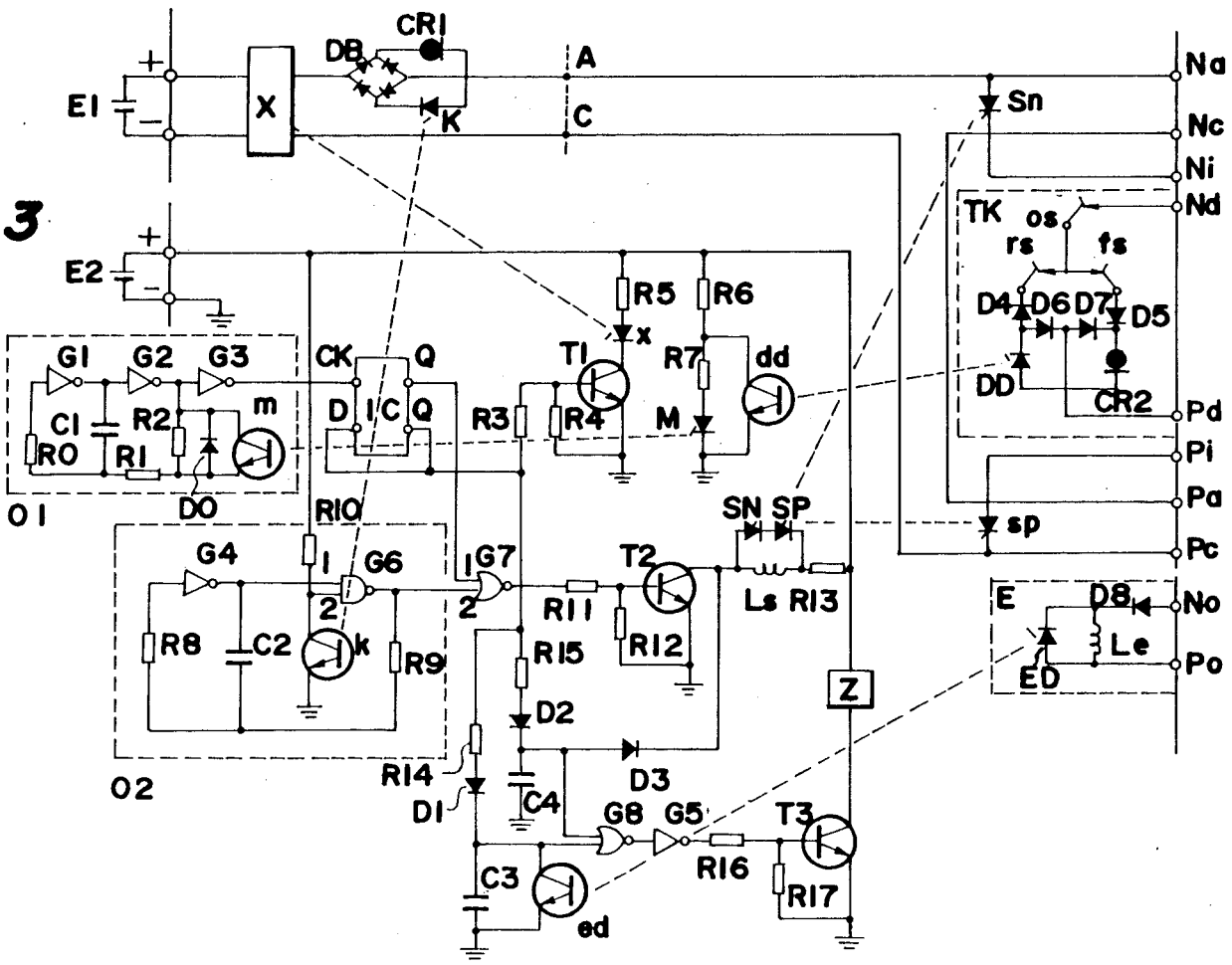
FIG. 3 is a circuit diagram showing an arrangement of a control circuit CS appearing in FIG. 1.

FIG. 3 shows a circuit arrangement of the control circuit CS which includes the direct current source E1, the power source E2 for operating the circuits, the polarity alternating circuit X for generating an alternate electric power, the current regulating circuit CR1, a multivibrator O1 for generating clock pulses, a multivibrator circuit O2 which operates slowly, a transmission signal driving circuit, a control signal receiving circuit TK, a terminal monitoring circuit E, a circuit for preventing a double operation of a transmitted signal, and an alarming circuit Z for warning upon occurrence of a short-circuit, disconnection and other defects of the transmission circuits.

Next, explanation will be given of the operation of each of the above-mentioned components of the control circuit CS. When the power is turned on, the multivibrator O1 and the slow multivibrator O2 start their operations.

(1) The polarity alternating circuit X for generating an alternate signal:

An input terminal CK of a D flip-flop IC is applied with a short pulse from an output gate G3 of the multivibrator circuit O1 for generating clock pulses which has a control circuit for controlling a photo-transistor m. Output terminals Q and $\underline{O}$ of the D flip-flop IC output a pulse at a rate of the half frequency. When the output $\underline{O}$ is at a high level (H) signal, a transistor T1 and a light emitting diode x are operated. Thus, the polarity alternating circuit X is controlled by repetition of high level and low level of the output $\underline{O}$ to generate an alternate signal of ±24 volts at alternate signal output terminals A and C.

(2) A starting circuit and a signal transmission circuit:

When a predetermined constant time has elapsed after the power is turned on, the output from a NAND gate G6 of the multivibrator circuit O2 becomes low level (L), and the output Q of the D flip-flop IC also becomes "L". At this time, the output from a NOR gate G7 becomes "H" and consequently a transistor T2 is turned on, whereby an inductor Ls is conducted. When the output Q from the D flip-flop goes high, the output from the gate G7 goes low, whereby the transistor T2 is turned off and consequently the current passing through the inductor Ls is interrupted. Then, the electromotive force generated in the inductor Ls is applied lo light emitting diodes SN and SP, whereby a photothyristor sn for generating a start signal, disposed between the alternate signal output terminal A and the driving terminal Ni, and a photothyristor sp for generating a start signal between he driving terminal Pi and the alternate signal output terminal C are conducted, thereby operating simultaneously the transmitter-receivers N1 and P1 at the first stage of the respective transmission circuits. Thus, the operation of the N and P transmission circuits is started.

(3) The start signal:

The start signal serves as a transmission signal source for the transmission circuits. Using the polarity alternation of the signals on the alternate signal lines 3 and 3' as shift pulse, the polarity of the lines are alternated, whereby the operating position of each transmitter-receiver is shifted one by one. In this manner, a single transmitted signal is circulated among all the transmitter-receivers.

A transmitted signal current passes from a signal line formed of the alternate signal terminal A, the photothyristor sn and the driving terminal Ni through a signal line in the transmitter-receiver N1 formed of the transmission line terminal I, the diode D1, an inductor L1 and the alternate signal line terminal NC, a signal line in the control circuit CS formed of the alternate signal line terminal Nc and the alternate signal line terminal Pa, and a signal line in the transmitter-receiver P1 formed of the alternate signal line terminal PA, the inductor L1, the diode D1 and the transmission line terminal 1, to a signal line in the control circuit CS formed of the driving terminal Pi, the photothyristor sp and the alternate signal terminal C.

(4) Operation of the first stage transmitter-receiver:

When the clock pulse is delivered and the output $\overline{O}$ of the D flip-flop goes high, the transistor T1 is turned on, whereby the polarity alternating circuit X is operated by a light emitting diode x. Then, the alternate signal output terminals A and C have their respective polarity reversed, and the transmitted signal current is interrupted, with the result that the photothyristors sn and pn return to the former condition. The inductor L1 of the transmitter-receivers N1 and P1 generates a counter electromotive force which is applied to a light emitting diode S1, whereby a photothyristor SCR1 is operated through an inductor L2 and this operation is maintained.

The signal is transmitted from a signal line formed of the alternate signal output terminal C and the alternate signal line terminal Pc, through a signal line in the transmitter-receiver P1 formed of the alternate signal line terminal PC, S1 of the photothyristor SCR, a diode D4, the inductor L2 and the alternate signal line terminal PA, a signal line in the control circuit CS formed of the alternate signal line terminal Pa and the alternate signal line terminal Nc, and a signal line in the transmitter-receiver N1 formed of the alternate signal terminal NC, the inductor L2, a diode D3, S1 of the photothyristor SCR and the alternate signal line terminal NA, to a signal line in the control circuit CS formed of the alternate signal terminal Na and the alternate signal output terminal A.

(5) Operation of the next stage transmitter-receiver:

When the polarity alternating circuit X reverses the polarity, the light emitting diode S1 of the photothyristor SCR returns to the former state, whereby a counter electromotive force generated by the conductive inductor L2 is supplied to S2 of the photothyristor SCR which thereby starts and maintains the operation, allowing the transmitter-receivers N2 and P2 at the next stage to start operating.

The signal flows from a signal line formed of the alternate signal output terminal A and the alternate signal line terminal NA, through a signal line in the transmitter-receiver N1 formed of the alternate signal line terminal NA, S2 of the photothyristor SCR and the transmission line terminal 0, a signal line in the transmitter-receiver N2 formed of the transmission line terminal 1, the diode D1, the inductor L1 and the alternate signal line terminal NC, a signal line in the control circuit CS formed of the alternate signal line terminal Nc and the alternate signal line terminal Pa, a signal line in the transmitter-receiver P2 formed of the alternate signal line terminal PA, the inductor L1, the diode D1 and the transmission line terminal I, and a signal line in the transmitter-receiver P1 formed of the transmission line terminal O, S2 of the photothyristor SCR and the alternate signal line terminal PC, through a signal line in the control circuit CS formed of the alternate signal line terminal Pc and the alternate signal terminal C.

(6) The control signal circuit and the control signal connecting circuit:

The former half wave FF or the latter half wave RR of one cycle, provided to each transmitter-receiver is supplied through the closed contact and the control signal line to a relay R of the receiver, wherein a light emitting diode DD of the control signal receiving circuit TK is turned on. At this time, a light emitting diode M and a photo-transistor m are turned off, so that the slow multivibrator circuit O1 is operated, with the result that the polarity alternating circuit X generate a signal of a long pulse width. This operation gives a sufficient conduction time for controlling the relay R of the receiver.

The control signal circuit has a branch circuit incorporated in the transmitter-receiver. When a switch S of the branch circuit is opened and therefore conduction is not allowed, the coil of the relay R in the receiver is not conductive either, thereby causing no change in condition. The alternate signal is the ordinary short-width pulse.

When a switch S of the branch circuit is closed, the coil of the relay R in the receiver is conducted, and accordingly an alternate signal of long-width pulse is generated through the control signal receiving circuit TK.

Therefore, regardless of on or off condition of the circuit, when the switch in the transmitter-receiver is opened, the control signal circuit is not conducted, and the alternate signal of short-width pulse is generated.

On the contrary, when the switch in the transmitter-receiver is closed, the control signal circuit is conduced, and the alternate signal long-width pulse is generated. At this time, LEDs LG provided in the transmitter-receivers N1 and P1 are lit to indicate that the transmitter-receiver is in operating condition.

Thus, when the transmitter-receiver is off, the signal is delivered from a signal line in the transmitter-receiver P formed of the diode D3, the relay R (off state), the light emitting diode LG for display and the control signal circuit terminal PD, through a signal line in the control circuit CS formed of the control signal terminal Pd, a diode D7, the current regulating circuit CR2, the light emitting diode DD, the diode D4, a switch rs, a switch os and the control signal terminal Ns, to a signal line in the transmitter-receiver N formed of the control signal circuit terminal ND, the light emitting diode LG, the switch S and the diode D4. The light emitting diodes LG of the transmitter-receivers N1 and P1 are lit.

At this time, the light emitting diode DD of the control circuit CS is operated by conduction of the control signal receiving circuit TK, and a photo-transistor dd short-circuits the light emitting circuit M, whereby the light emitting diode M is inoperative and the photo-transistor m is turned off. A capacitor C1 in the multivibrator circuit O1 is slowly charged through a resistor R2 by the photo-transistor m turning off, and therefore, the cyclic period of alternation of the polarity is extended to provide a long pulse width.

Subsequently, the clock input terminal CK of the D flip-flop IC is supplied with a clock pulse which has a longer low-level period, whereby the flip-flop IC delivers the output Q which has a longer high-level period to provide a conduction time long enough to move the relay R of the transmitter-receiver to off state. When the capacitor C is charged and the circuit is reversed, the charged capacitor C is rapidly discharged through a diode Do, whereby the input CK of the D flip-flop IC is supplied with the clock pulse at low level. At this time, the output $\underline{O}$ remains at high level.

Next, when the input CK of the D flip-flop IC goes high, the output $\underline{O}$ of the same also goes high, to thereby change the operating condition of the transistor T1, the light emitting diode x and the polarity alternating circuit A.

The control signal circuit, at this time, has the switch S in the branch circuit opened so that the line is interrupted. The contact r of the relay R in the transmitter-receiver P2 is at the position where an external signal terminal PR is contacted with an external signal terminal PR.

(7) When the transmitter-receiver is on:

In the present embodiment, the transmitter-receivers N3 (N-Si) and P3 (P-R) are assumed to be In on state, wherein a transmission line is established from a signal line in the transmitter-receiver N3 formed of the transmission line terminal I. the diode D2, the switch S. the light emitting diode LR and the control signal circuit terminal ND, through a signal line in the control circuit CS formed of the control signal terminal Nd, the switch os, a switch fs, a diode D5, the current regulating circuit CR2, the light emitting diode DD, a diode D6 and the control signal terminal Pd, to a signal line in the transmitter-receiver P3 formed of the control signal terminal PD, the light emitting diode LR, the re)ay R (at the on position), the diode D2 and the transmission line terminal I.

The control signal circuit, at this time, has the switch S in the branch circuit closed and is therefore conducted, whereby the relay R of the transmitter-receiver P3 is turned on and the contact r is moved to the other position. Therefore, the terminal PR is disconnected to the terminal PR, and instead, the terminal PS is connected to the terminal PR through the contact r to control another apparatus. The transmitter-receivers P3 and N3 then have their light emitting diode LR lit correspondingly.

As mentioned above, each of the transmitter-receivers is provided with an equal cycle period, and in accordance with the operating condition of the relay R, i.e. on or off of the relaY R, the position of the contact r is changed.

When the switch of the transmitter-receiver is closed, in the control circuit CS. the light emitting diode DD is turned on, the light emitting diode H is turned off, and the photo-transistor m is turned off, through the control signal circuit. Thus, the multivibrator O1 is slowly operated, whereby the polarity alternating circuit X generates a long-width pulse. This operation provide a conduction time long enough to control the relay R of the receiver.

Since the control signal receiving circuit TK is provided with the current regulating circuit CR2 which regulates the control signal current, the operation of the relay R and the light emitting diode for indicating the operating condition can be stably operated, without influenced by location.

Also, the control circuit CS provides the control signal receiving circuit TK with a switch which gives functions of control stop SWos, operation stop SWfs and return stop SWrs. When the switch is changed over to provide the control stop function SWos, the circuit TK is maintained in a condition at the time the switch is changed, without effecting other operation nor returning to the former condition. The operation stop function SWfs allows (he control signal in operative condition to return to the former condition, however, a new operation is not effected. The return stop function SWrs maintain the signal in the current condition, but does not allow the same to return to the former condition.

(8) The current regulating circuits CR1 and CR2:

The alternating signal line is provided with the current regulating circuit CR1 which allows a stable operation without influence due to the location of the transmitter-receiver, assures the tolerable resistance of the transmission line and protects the transmission circuit and transmitter-receivers from troubles caused by short circuit or the like, to thereby ensure fidelity of the transmission line.

Also, the control signal receiving circuit TK is Provided with the current regulating circuit CR2 for regulating the current which flows through the control signal circuit.

When the control signal current flows, it is derived from the signal transmission circuit, so that a difference occurs in the transmitted current. If such difference is too large to be ignored, a feedback circuit may be provided at the light emitting diode DD for compensating for the current regulating circuit CR1.

In the present embodiment, the N transmission circuit 1 and the P transmission circuit 2 are connected in series, and only one current regulating circuit, i.e. the circuit CR1 is provided for the two transmission circuit. Alternatively, a current regulating circuit may be provided for each of the transmission circuits and the two current regulating circuits are connected in parallel to the polaritY alternating circuit, wherein a synchronous operation and a control signal circuit can be realized. Also, it is possible that a current regulating circuit is provided for one o& the transmission circuits. Particularly, if the signal transmission line is short, the current regulating circuit may be substituted by a protective resistor.

(9) The terminal monitoring circuit:

A transmitted signal, after passing through the respective transmitter-receiver, returns from the transmitter-receivers Nn and Pn at the last stage to transmitted signal feedback terminal No and Po of the control circuit CS.

Thus, a transmitted signal flows from the alternate signal terminal A, through the alternate signal line terminal Na, a signal line in the transmitter-receiver Nn formed of the alternate signal line terminal NA, the photo-transistor S2 and the transmission line terminal 0, a signal line in the control circuit CS formed of the transmitted signal feedback terminal No, a diode D8, an inductor Le and the transmitted signal feedback terminal Po, and a signal line in the transmitter-receiver Pn formed of the transmission line terminal 0, the photo-transistor S2 and the alternate signal line terminal PC, to a signal line in the control circuit CS formed of the alternate signal line terminal Pc and the alternate signal output terminal C.

Through the above signal path, the transmitted signal is supplied to the terminal monitoring circuit E.

When the inductor Le of the terminal monitoring circuit E is conducted by a transmitted signal current and thereafter the polarity alternating circuit X reverses the polarity normally, the diodes D8 of the terminal monitoring circuit E blocks the transmitted signal current, whereby a counter electromotive force is generated in the inductor Le and accordingly a light emitting diode ED is operated. Thus, the operation of the light emitting diode ED allows confirming that a transmitted signal has passed through all the transmitter-receivers and returned. In this event, a photo-transistor ed makes the alarming circuit Z inoperative.

(10) A signal repetition preventing circuit and an alarm for announcing a trouble in the transmission lines:

A light emitting diode K for monitoring a single transmitted signal, during transmission, is adapted to maintain an input I2 of the gate G6 at the low level, whereby the multivibrator circuit O2 is inoperative. A transmitted signal which has passed through the transmission line returns to the terminal monitoring circuit E and interrupted by the diode D8. Then, the light emitting diode K is turned off. In this condition, the absence of the transmitted signal is confirmed by a phototransistor k, the photothyristor sn and sp are operated.

The multivibrator circuit O2 has a signal repetition preventing function and an alarming function. The former is function performed by the phototransistor K for monitoring a single transmitted signal on the transmission lines to prevent a transmitted signal to be repeatedly transmitted. The latter function is achieved, upon detecting the absence of a transmitted signal at the terminal monitoring circuit E for a predetermined time period, for example, due to short-circuit, interruption, and so on of the transmission lines, such that the potential of the capacitor C3 is elevated, whereby an input I2 of a NOR gate G8 goes high, the output of the same goes low, the output of the gate G5 goes high, and consequently the alarming circuit Z warns the occurrence of a malfunction.

Figure 4:
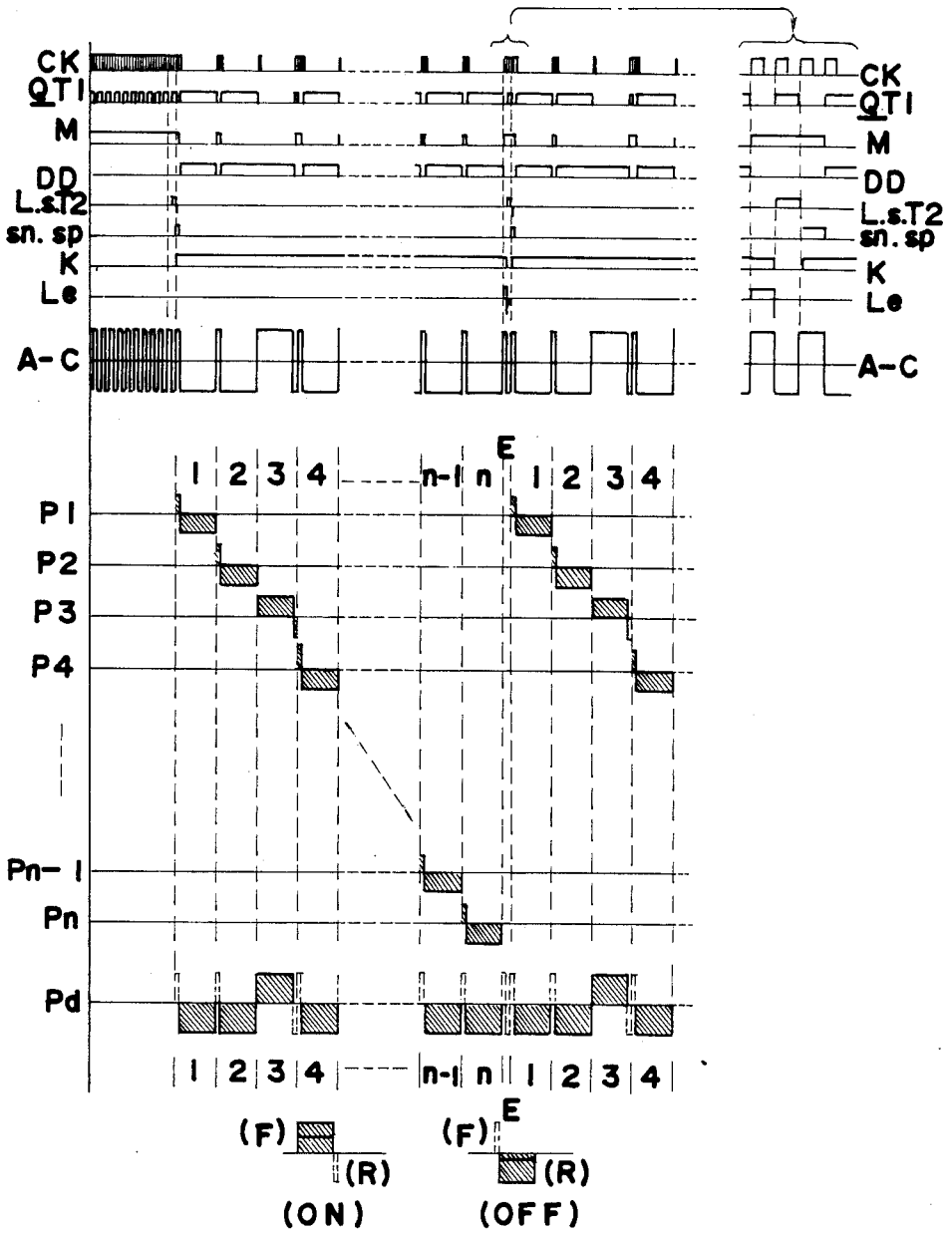
FIG. 4 (CK-Pd) is timing charts showing waveform of signals at different locations in the circuits shown in FIGS. 2 and 3.

FIG. 4 shows liming charts of signals at respective locations of the system of the present embodiment. The former half wave FF and the latter half wave RR of one cycle are respectively assigned to ON signal and OFF signal.

The charts show that the transmitter-receiver-receiver N3 is operative and the transmitter-receiver P3 is in a receiving condition.

A chart A-C shows the voltage waveform of the alternate signal, CK the waveform of the input signal to the D flip-flop IC, $\underline{O}$ the waveform of the output Q of the D flip-flop, and $\overline{\text{Ls}}$ the voltage waveform at the inductor Ls.

Also, a chart sn,sp shows the waveform of the current at the photothyristor for the start signal, and P1-Pn the waveform of the currents at the alternate signal line terminal PA of the respective transmitter-receivers P1-Pn.

Further, a chart Pd is the waveform of the current at the control signal terminal Pd of the control signal receiving circuit TK, K the wave of the current at the light emitting diode K for monitoring a single transmitted signal, and Le the waveform of the voltage al the inductor Le.

Since the system of the present invention, as described above, is formed of transmitter-receivers which have a single ON-OFF function and employ a single cable, it is readily adaptable not only to both concentrated and distributed transmission facilities but also to modification and extension of the facility.

Also, the present system enables a bi-directional transmission and its control, so that it is appropriate)y applied to a monitor and control system for security.

The provision of a current regulating circuit for the transmission circuit allows a large line tolerable resistance, so that the operation of the transmitter-receivers will never be influenced by remote or close location in the transmission line, whereby each of the transmitter-receivers can stably perform their operation in the same current condition.

Since a single signal is transmitted, a large signal current can be applied, so that the noise durability of the system can be improved. This advantage makes it possible to directly drive the relay R in resPective transmitter-receivers with a large control current and display ON or OFF state of each transmitter-receiver with LED by means of a control current to regularly monitor the operating condition of the system. Thus, useful functions can be provided for control and handling of the system.

The transmitter-receiver employed in the present system is based on a simple operating principle and formed in a simple construction, so that it is possible to provide such system having a number of features and functions, with a low trouble ratio, a small size and a low cost. Similarly, the control circuit is also simple in construction and easy in handling.

It is also appreciated that the transmitter-receivers although divided into those for transmission and for reception, is not assigned its own address so that common products can be employed for them, which is also advantageous in the administration of production and stock of the transmitter-receivers.

A common line transmission system, in general, requires a large tolerable resistance of the line which can be provided by the signal control system of the present invention.

Moreover, a general cable can be employed for the signal line, so that further reduction in cost can be obtained.

As described above, the present invention can provides an improved and low-cost signal control system which is applicable to a variety of monitoring and controlling systems.

What is claimed is:

1. A signal control system for transmission circuits comprising:

two ring counter type transmission circuits respectively formed of a plurality of transmitter-receivers arranged in paired opposition to each other each of said transmission circuits having two alternating current signal lines, a control line and a transmission line, control means for operating said transmitter-receivers including means for providing a shift pulse effecting initially the simultaneous operation the first transmitter-receiver of each transmission circuits, and thereafter synchronously operating each of subsequent pairs of the transmitter-receivers in turn.

2. A signal control system according to claim 1, wherein said two alternating current signal lines and said control line connect said transmitter-receivers of the respective transmission circuits in parallel and said transmission line connects said transmitter-receivers of the respective transmission circuits in series.

3. A signal control system according to claim 1, wherein said alternating current signal lines are provided with a current regulating circuit.

4. A signal control system according to claim 3, wherein said control means comprises a polarity alternating circuit connected to said alternating current signal lines through said current regulating circuit.

5. A signal control system according to claim 1, wherein said shift pulse is impressed as a signal on said alternating current signal lines.

6. A signal control system according to claim 4, wherein said signal on said, alternating current signal lines is an alternate signal supplied from a power source.

7. A signal control system according to claim 1, wherein each of the paired transmitter-receivers receive and transmit a control signal through said control signal line.

8. A signal control system as claimed in claim 4, wherein each of said transmitter-receivers transmits or receives an ON control signal or an OFF control signal at the former half wave of the signal on the alternating current signal lines and transmits or receives the OFF control signal or the ON control signal at the latter half wave of the same.

9. A signal control system as claimed in claim 7, wherein one cycle period of said signal on the alternating current signal lines is equal, and the duty ratio o& the former half wave to the latter half wave is converted in accordance with on or off condition of each of the transmitter-receivers.

10. A signal control system according to claim 1, wherein said control means further comprises a terminal monitor means for monitoring transmission of a transmitted signal and alarm means for indicating trouble in said transmission circuits.

* * * * *